United States Patent [19]

McElhaney

[11] Patent Number: 4,627,257

[45] Date of Patent: Dec. 9, 1986

[54] TUBE SPIN CLOSE APPARATUS

[75] Inventor: William G. McElhaney, Jacksonville, Tex.

[73] Assignee: Coilco, Inc., Dallas, Tex.

[21] Appl. No.: 146,755

[22] Filed: May 5, 1980

[51] Int. Cl.[4] ..... B21D 15/00

[52] U.S. Cl. ..... 72/102; 228/60

[58] Field of Search ..... 72/84, 102, 108, 109; 228/60, 31

[56] References Cited

U.S. PATENT DOCUMENTS

| | | | |
|---|---|---|---|
| 1,751,035 | 3/1930 | Hopkins | 72/121 |
| 1,939,770 | 12/1933 | Enghauser | 228/60 X |
| 2,351,020 | 6/1944 | Dewey | 228/60 X |
| 2,408,596 | 10/1946 | Bednar et al. | 72/69 |
| 2,709,381 | 5/1955 | Enghauser | 228/60 X |
| 2,754,705 | 7/1956 | Enghauser | 228/60 X |
| 2,988,805 | 6/1961 | Thompson | 72/110 X |
| 3,225,998 | 12/1965 | Bowman | 228/60 X |
| 3,265,279 | 8/1966 | Bowman | 228/60 X |
| 3,740,986 | 6/1973 | Schmid | 72/84 |
| 3,793,863 | 2/1974 | Groppini | 228/60 X |
| 4,038,850 | 8/1977 | Sakagami | 72/84 X |

FOREIGN PATENT DOCUMENTS

| | | | |
|---|---|---|---|
| 1045533 | 1/1979 | Canada | 72/102 |
| 296612 | 3/1971 | U.S.S.R. | 72/84 |

*Primary Examiner*—Nicholas P. Godici
*Assistant Examiner*—Richard K. Seidel
*Attorney, Agent, or Firm*—Richards, Harris, Medlock & Andrews

[57] ABSTRACT

An apparatus (20) for closing the end of a tube section includes a rotary means (180, 190) for rotating the tube section about the longitudinal axis of the tube section. A forming wheel (54) is mounted relative to the end of the tube section. The forming wheel (54) is freely rotatable about an axis substantially parallel to the rotational axis of the tube section. Structure (26) is provided for moving the forming wheel in a plane substantially perpendicular to the axis of rotation of the tube section and into engagement with the end of the tube section to close the end thereof.

24 Claims, 6 Drawing Figures

TUBE SPIN CLOSE APPARATUS

TECHNICAL FIELD

The present invention relates to an apparatus for spin closing the end of a tube section.

BACKGROUND ART

Many heat exchange devices include tube sections with ends which must be closed or capped. For example, in the production of a heat exchange coil, certain end component tube sections must be completely closed to properly control the flow of fluid in and through the heat exchange coil.

In the past, several techniques have been used to completely close the end of a tube section. One method has been to solder a cap or end piece over the end of the tube to completely close the tube. Other methods have involved mounting the tube in a stationary chuck and closing the end thereof by forcing a rotating swagging tool into frictional engagement with the end portion of the tube. In this operation, heat is generated by the frictional engagement between the tool and the stationary tube section and the end portion of the pipe is conformed to a closed configuration.

Other apparatus used to close the end of a tube section include fixedly mounting the tube section and engaging the end by a rotating disc to pinch off and close the end of the tube section. An example of this type of apparatus is disclosed in the patent to D. Bowman, U.S. Pat. No. 3,225,998, issued Dec. 28, 1965. As in most prior art tube closing devices, the apparatus disclosed in the Bowman patent applies heat to the end of the tube prior to performing the closing process.

Other pipe closing apparatus operate by rotating the tube section about its longitudinal axis while engaging the end of the tube or pipe at spaced circumferential points thereabout to force the edge of the pipe inwardly either to form it or to close the pipe end. Examples of these devices are disclosed in the patents to R. K. Hopkins, U.S. Pat. No. 1,751,085, issued Mar. 18, 1930, the patent to Groppini, U.S. Pat. No. 3,793,863, issued Feb. 26, 1974 and the patent to W. L. Enghauser, U.S. Pat. No. 2,709,381, issued May 31, 1955. As in the patent to Bowman referred to above, each of these devices requires and uses the application of heat to the end of the pipe prior to the end forming operation.

While these prior art devices have been of limited success, these prior art systems have been overly complex and those requiring or generating heat during the forming operation introduce a critical disadvantage to the operation.

DISCLOSURE OF THE INVENTION

The present invention provides an improved apparatus for closing the end of a tube or pipe section which overcomes many of the disadvantages heretofore experienced in the prior art while simplifying the apparatus required to complete the tube closing process.

In accordance with one embodiment of the invention, the apparatus for forming the end of a tube section includes structure for rotating the tube section about the longitudinal axis thereof. A forming wheel is mounted relative to the end of the tube section and is freely rotatable about an axis substantially parallel to the rotational axis of the tube section. Structure is provided for moving the forming wheel in a plane substantially perpendicular to the axis of rotation of the tube section and into engagement with the end of the tube section to form the end thereof. Forming of the end of the tube section is conducted without the application of heat to the tube section.

In accordance with one embodiment of the invention, the forming wheel is a right cylinder section and the end of the tube is contacted by the cylindrical wall surface thereof. The forming wheel is moved past the center of the tube section and as a result of the engagement of the end of the tube section by the cylindrical sidewall of the forming wheel, the end of the tube is turned inwardly to close the end of the tube section.

This process is completed without raising the temperature of the tube section, by friction or otherwise, to any appreciable extent.

In accordance with another embodiment of the invention, the forming wheel is a right cylinder section having a curvilinear surface formed along the circumferential edge of one face of the wheel. The curvilinear surface is positioned to contact the edge of the tube section upon advancement of the forming wheel against the tube section. Generally, the curvilinear surface is concave and thus will serve to facilitate turning the wall of the tube section inwardly to close the end of the tube section during the forming operation.

In accordance with the primary embodiment of the invention, the structure for moving the forming wheel into engagement with the tube section includes guide post structure and a sliding block slidable on the guide post and rotatably supporting the forming wheel. Structure is provided for moving the slide block relative to the tube section. A controller is incorporated to limit the movement of the forming wheel relative to the end of the tube section. Therefore, although the forming wheel is normally moved past the center of the tube section, the movement of the forming wheel may be limited to movement across only a part of the face of the end of the tube section to either fully or partially close the end of the tube section.

In accordance with another embodiment of the invention, a mandrel may be inserted into the end of the tube section prior to forming thereof and the forming wheel may be moved against the tube section to form the end of the tube section to the contour of the mandrel.

In accordance with another aspect of the invention, the tube forming apparatus includes adjustment structure for setting the location of the tube section relative to the forming wheel. This adjustment structure includes a clamp or chuck arrangement for selectively clamping the tube section in the rotary structure and adjustable stop structure for positioning the tube section relative to the forming wheel. Structure is provided for ejecting the tube section from the clamp structure upon release of the tube section.

In accordance with the primary embodiment of the invention, the rotary structure includes a rotating tubular shaft supported for rotation about its longitudinal axis and a clamp or chuck arrangement mounted to one end of the rotating shaft for receiving the tube section therein. The adjustable stop structure includes a stop rod mounted within the rotating shaft. The rod is adjustable axially within the shaft and has an end confronting the tube section as it is inserted in the clamp structure. Thus, by axially adjusting the stop rod within the rotating shaft and by introducing the tube section within the shaft until it engages the rod, the tube section may be set as desired relative to the forming wheel.

In accordance with one embodiment of the invention, the structure for ejecting the tube section from the forming apparatus includes a cap member mounted on the end of the stop rod and a spring mounted between the cap member and the end of the stop rod. Prior to clamping the tube section within the rotatable shaft, the spring mounted between the cap member and rod end is compressed by applying an axial force on the tube section. Subsequent to the forming operation, the clamp structure is released and expansion of the compressed spring acts to eject the tube section from the apparatus.

BRIEF DESCRIPTION OF THE DRAWINGS

For a more complete understanding of the present invention, and for further details and advantages thereof, reference is now made to the following description taken in conjunction with the accompanying drawings, in which.

DETAILED DESCRIPTION

Figure 1:
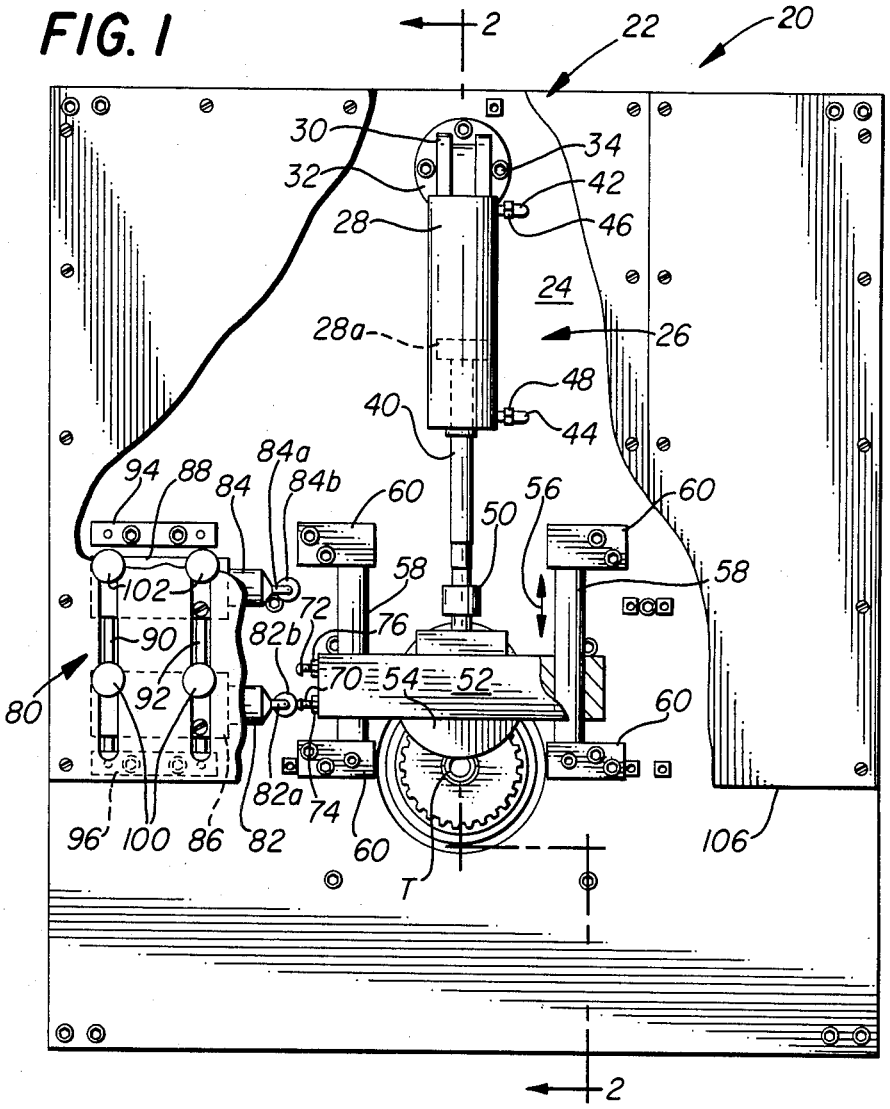
FIG. 1 is a partially broken away front view of the apparatus of the present invention.
Figure 4:
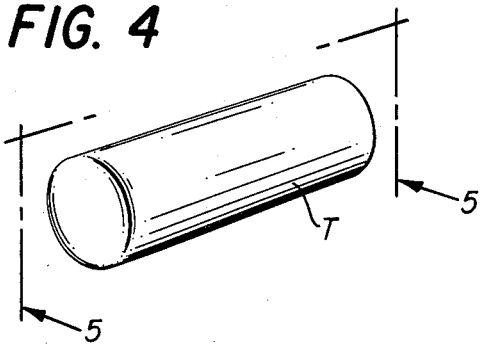
FIG. 4 is a perspective view showing a tube section which has been closed by the apparatus of the present invention, FIG. 5 a section view taken along line 5—5 of FIG. 4.
Figure 5:
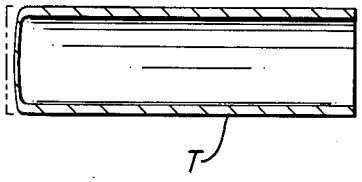

Referring to FIG. 1, the tube closing apparatus 20 of the present invention includes a frame 22 having a front plate 24. A forming wheel actuation assembly 26 is mounted to plate 24 and includes a hydraulic cylinder 28 having a pair of lugs 30 on one end thereof attached to a mount structure 32. Mount structure 32 is attached to plate 24 by appropriate bolts 34. Hydraulic cylinder 28 has a piston 28*a* therein and an actuating ram 40 extends from cylinder 28 opposite the attachment of the cylinder to plate 24. Inlet and exhaust hoses 42 and 44 are attached to cylinder 28 at appropriate fittings 46 and 48, respectively.

The end of ram 40 opposite cylinder 28 is attached by coupler 50 to a slide block 52. Slide block 52 rotatably supports a forming wheel 54 and is supported for movement in the direction of arrows 56 on guide post 58. Guide posts 58 are mounted to plate 24 by appropriate pillow blocks 60 which are in turn mounted to plate 24 by appropriate bolts. Limit bolts 70 and 72 are threadedly engaged into slide block 52 and may be adjusted relative thereto and locked in place by lock nuts 74 and 76. A microswitch control assembly 80 is mounted to one side of forming wheel actuation assembly 26 and includes a lower microswitch 82 and upper microswitch 84 mounted in blocks 86 and 88, respectively. Blocks 86 and 88 are slidably received on two guide posts 90 and 92 mounted to plate 24 by upper and lower guide blocks 94 and 96, respectively. Guide blocks 94 and 96 are attached to plate 24 by appropriate bolts as indicated. Blocks 86 and 88 have apertures therethrough through which guide posts 90 and 92 are received. Blocks 86 and 88 are selectively positioned along guide posts 90 and 92 by the engagement of threaded screws 100 and 102 threadedly received within blocks 86 and 88, respectively, for locking engagement against guide post 92. Blocks 86 and 88 may be selectively moved relative to guide posts 90 and 92 by loosening screws 100 and 102. The position of these blocks is set by advancing screws 100 and 102 until the screws engage guide post 92. By positioning blocks 86 and 88, microswitches 82 and 84 are positioned vertically as desired for purposes to be hereinafter discussed.

Microswitches 82 and 84 have actuation arms 82*a* and 84*a*, respectively, extending therefrom. Arm 82*a* has a roller 82*b* mounted thereon and arm 84*a* has a similar roller 84*b* mounted thereon. Rollers 82*b* and 84*b* are positioned in line with bolts 70 and 72 extending from slide block 52. A cover or shield 106, partially broken away in FIG. 1 for clarity, is mounted to plate 24 to shield forming wheel actuation assembly 26, slide block 52, forming wheel 54 and microswitch control assembly 80.

Figure 2:
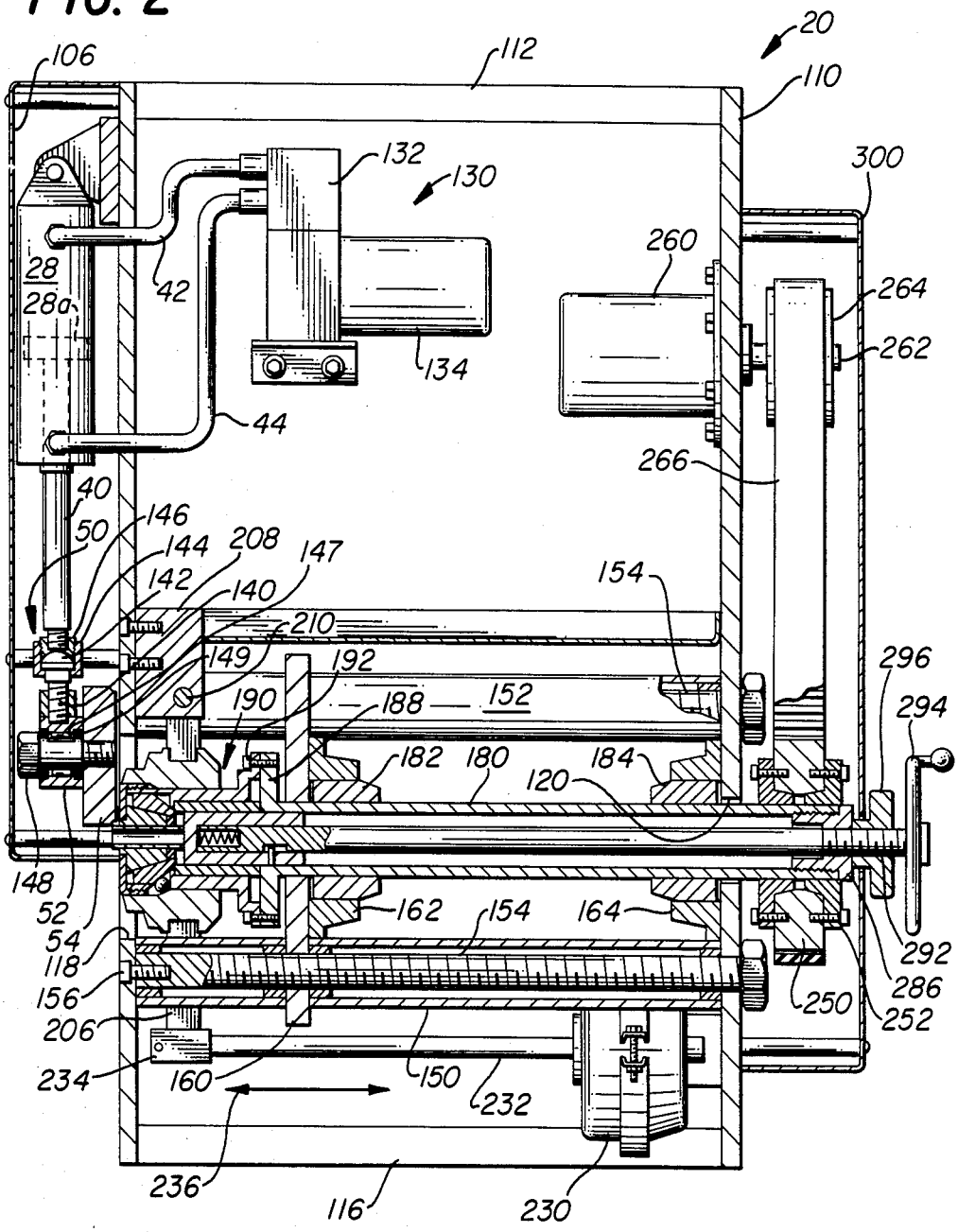
FIG. 2 is a section view taken along line 2—2 of FIG. 1.

Referring now to FIG. 2 in conjunction with FIG. 1, frame 22 includes a rear plate 110 maintained in a spaced parallel relationship from front plate 24 by upper cross member 112, intermediate cross member 114 and lower cross member 116 attached therebetween. As can be seen in FIG. 2, front plate 24 has an aperture 118 therethrough and rear plate 110 has an aperture 120 therethrough.

A hydraulic pump and supply 130 is mounted relative to front plate 24 by appropriate bracket and fittings 131. Hydraulic pump and supply 130 includes a pump unit 132 and supply unit 134. Hoses 42 and 44 from hydraulic cylinder 28 are connected by appropriate fittings 136 and 138, respectively, to hydraulic pump 132. As can be seen in FIG. 2, hose 42 communicates with cylinder 28 above piston 28*a* and hose 42 communicates within cylinder 28 below piston 28*a*. Thus, by directing fluid from pump 132 through hose 42 to cylinder 28, piston 28*a* is made to move downwardly thereby moving slide block 52 and forming wheel 54 in a downward direction. Similarly, by directing hydraulic fluid from pump 132 through hose 44 and to cylinder 28, piston 28*a* is moved upwardly within cylinder 28 thereby raising forming wheel 54.

As can be seen in FIG. 2, coupler 50 includes a bolt 140 threadedly received within slide block 52 and having a swivel head 142 coupled to the threaded end of hydraulic ram shaft 40 by a two-piece sleeve and insert 144 and 146, respectively. As a result of this arrangement, slide block 52 is free to maintain precise alignment in its movement as determined by guide post 58.

Figure 3:
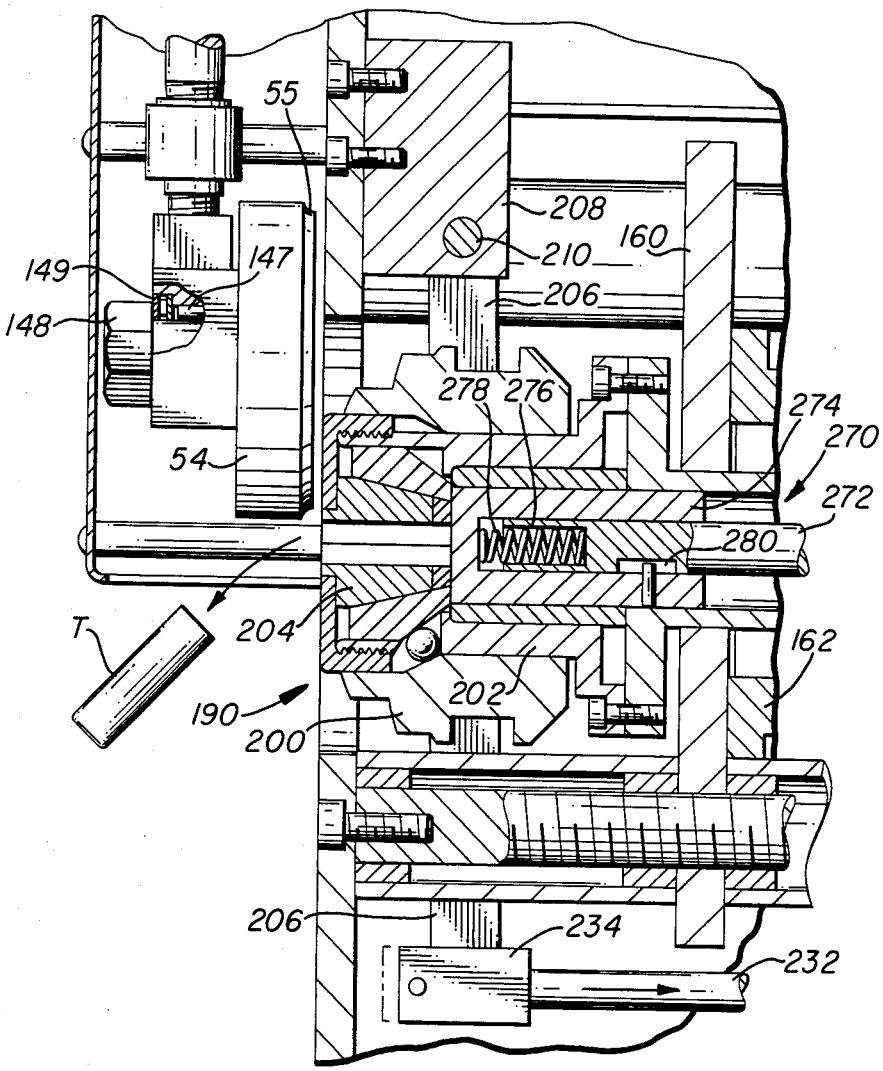
FIG. 3 is an enlarged section view showing the clamp structure and forming wheel of the present invention

Referring to FIGS. 2 and 3, forming wheel 54 is attached to slide block 52 by a shoulder bolt 148. Shoulder bolt 148 is free to rotate in needle roller bearing 147 mounted in slide block 52. Thrust bearings 149 are mounted within annular recesses within slide block 52 and between slide block 52 and the head of shoulder bolt 148 and forming wheel 54. Forming wheel 54 is free to rotate relative to slide block 52 at all times during the operation of the present apparatus. A groove 55 is formed circumferentially along the edge of the face of wheel 54 confronting plate 24.

Front plate 24 and rear plate 110 are also maintained in a spaced and supported relationship one to the other by spacers 150 and 152 mounted relative to front and rear plates 24 and 110 by bolts 154 and 156. A front bearing mounting block 160 is mounted between spacers 150 and 152 and supports a front bearing mount 162 thereon. A rear bearing mount 164 is mounted against rear plate 110 and between spacers 150 and 152. A tubular rotating shaft 180 is supported for rotation about its longitudinal axis within bearing mounts 162 and 164 by flange bearings 182 and 184, respectively. Rotating shaft 180 has a rear end protruding through aperture 120 of rear plate 110. At its opposite end, rotating shaft 180 has a flange 188 formed thereon. A collet chuck assembly 190 is mounted to flange 188 by bolts 192 with the mouth 194 of chuck assembly 190 aligned with the rotational axis of shaft 180.

As is more clearly shown in FIG. 3, collet chuck assembly 190 is of the standard design and may be any one of several multi-size collet chuck assemblies produced by Pratt Burnerd American, Inc. of Springfield, Mich. Collet chuck assembly 190 includes an outer body collar 200 which may be moved relative to an inner sleeve 202 to close or open jaws 204. Collar 200 is moved relative to sleeve 202 by the movement of a collar ring 206 having an upper end pined at anchor bar 208. Anchor bar 208 is fixedly attached to front plate 24 by appropriate bolts as shown. Pivoting of ring 206 at anchor bar 208 is about pin 210. The end of ring 206 opposite pin 210 is connected to a pneumatically operated air cylinder 230 by arm 232 and connecting fitting 234. By the actuation of brake assembly 230, arm 232 is extended or retracted in the direction of arrow 236. When extended, collar 200 moves relative to sleeve 202 to cause jaws 204 to clamp inwardly against tubing positioned therewithin. By retracting arm 232, jaws 204 are made to open and release the clamping force on the tube piece mounting within the collet chuck.

A pulley 250 is mounted on the end of shaft 180 extending through rear plate 110. Pulley 250 is attached to shaft 180 by taper block bushings 252 in the usual manner. A drive motor 260 is mounted to rear plate 110 above shaft 180 by appropriate bolts with its shaft 262 extending through plate 110. A pulley 264 is mounted on shaft 262 immediately above pulley 250 on shaft 180, and a toothed belt 266 is entrained around both pulleys 264 and 250. By activation of drive motor 260, and through belt 266, pulley 250 is driven to drive shaft 180.

Referring to FIGS. 2 and 3, a tube section positioning and ejection assembly 270 is disclosed. The positioning and ejection assembly 270 includes a tube stop rod 272 mounted within rotating shaft 180. An end cap 274 is mounted within shaft 180 and receives the end of tube stop rod 272 therein. Tube stop rod 272 has an axial bore 276 therein in the end thereof and a compression spring 278 is trapped within the bore and end cap 274. Tube stop rod 272 has a key way 280 formed therein, and a pin 282 is mounted through an aperture in cap 274 into key way 280 to facilitate the insertion and removal of the end cap and tube stop rod as one unit.

The end of tube stop rod 272 remote from end cap 274 is aligned concentrically within rotating shaft 180 by an appropriate guide rod bushing 286 (FIG. 2). Bushing 286 is threadedly engaged internally within rotating shaft 180 and has an aperture therethrough with threads for engagement with threads 292 on tube stop rod 272. A crank 294 is mounted on the end of tube stop rod 272. Thus, by rotating crank 294, tube stop rod 272 may be threaded inwardly or outwardly relative to bushing 286 to move the end cap attached to the opposite end of tube stop rod 272 axially within tubular shaft 180. A lock nut 296 is also threadedly received on tube stop rod 272 for locking tube stop rod 272 relative to rotating shaft 180.

A cover or shield 300 is mounted to rear plate 110 by appropriate bolts to shield pulleys 264 and 250 and belts 266 and entrained therearound. Similarly, cover 106 is mounted to the forward plate 24 by appropriate bolts to shield forming wheel actuation assembly 26, slide block 52 and forming wheel 54.

The operation of the tube spin close apparatus of the present invention may now be fully described. Collet chuck assembly 190 is opened by actuating air cylinder 230 which is operated either pneumatically or electrically by an appropriate controller of well known design to retract arm 232 and open jaws 204 of the collet chuck. A section of tubing T corresponding to the jaw size of the collet chuck assembly 190 is manually inserted within jaws 204 of the chuck. Tube stop rod 272 is adjusted relative to shaft 180 and relative to forming wheel 54 by the rotation of crank 294 such that the end of tube section T is positioned appropriately relative to forming wheel 54 when the tube section T is engaged within the collet chuck against end cap 274 bottoming end cap 274 against rod 272 as shown in FIG. 2. As will be appreciated, in this position, spring 278 is compressed. With tube section T held in this position, air cylinder 230 is actuated to extend arm 232 causing collet chuck assembly 190 to clamp tube section T therein.

In accordance with the primary embodiment of the present invention, tube section T is appropriately adjusted relative to forming wheel 54 when the end or edge of the tube section is substantially in line with the concave groove 55 formed along one circumferential edge of forming wheel 54. Further, the edge of tube T will be extending from collet chuck assembly 190 approximately 3/16 inch for a $\frac{5}{8}$ inch diameter copper tube. The appropriate extension from the collet chuck and overlap engagement by the forming wheel will vary depending upon the type of tube employed and its physical dimensions, both in diameter and tube thickness. The appropriate extension necessary to result in the complete closing of the end of the tube can easily be determined for any size or material used. It will be understood that the above referenced dimensions are only approximate and are not intended to limit the scope of the present invention.

With the tube section clamped within the collet chuck assembly 190, drive motor 260 is actuated by an appropriate controller, either in response to or timed relative to the actuation of air cylinder 230 or through manual operation by an operator. The actuation of drive motor 260 results in the rotation of pulley 264 to drive pulley 250 and rotate drive shaft 180. Rotation of drive shaft 180 results in the rotation of collet chuck assembly 190 and the rotation of tube T about its longitudinal axis.

Only by way of example, rotation of the tube chuck on the order of 1725 RPM has been found to be appropriate for the closing of a copper tube section having a $\frac{5}{8}$ inch diameter.

With the tube section T rotating, hydraulic fluid is directed by pump 132 through hose 42 into cylinder 28. This results in the downward movement of hydraulic ram 40 to move slide block 52 along guide post 58. This translation brings forming wheel 54 into engagement with the end of tube section T. As forming wheel 54 engages tube section T, it is free to rotate about its axis defined by shoulder bolt 148 in needle bearing 147. In the primary embodiment of the present invention, forming wheel 54 moves to a given distance past the center of the tube section T causing the end to be spin closed.

During forming of the end of the pipe section, wheel 54 is free to rotate as a result of its engagement with tube section T. Because the present invention eliminates exclusive frictional engagement, no heat is generated during forming. Moreover, the present invention does not require heating of the tube section to form the tube section.

As viewed from FIG. 1, microswitch 82 is appropriately positioned to be engaged by bolt 70 on slide block 52 to indicate the lowermost movement of forming wheel 54. When bolt 70 engages microswitch roller **82*b*, a signal is provided from microswitch 82 to a controller which in turn stops the flow of fluid from pump 132 through hose 42 to cylinder 28 and directs fluid from pump 132 through hose 44 to cylinder 28. As a result, ram 40 is raised to draw slide block 52 and forming wheel 54 upwardly. Again, when bolt 72 on slide block 52 engages upper microswitch roller 84*b*, a signal is provided to a controller which stops the pumping of fluid through hose 44 to cylinder 28, and the movement of slide block 52 and forming wheel 54 is arrested. Either automatically in a timed sequence subsequent to the actuation of microswitch 84, or manually, brake assembly 230 is activated to retract arm 232 thereby releasing the engagement of tube section T. With the release of tube section T, spring 278 acts to extend end cap 274 from tube stop rod 272 to eject tube section T from collet chuck assembly 190**. With the ejection of the closed tube section, another section of tubing may be loaded within the spin close apparatus of the present invention.

As will be appreciated, pieces of tube section longer than those illustrated in the figures may be closed in the present apparatus by merely withdrawing tube stop rod 272 through rotation of crank 294. Tube sections longer than that which may be fitted within shaft 180 may also be accommodated by the present invention by completely removing tube stop rod 272 from the system. This is accomplished by removing rod guide bushing 286 and withdrawing tube stop rod 272 and end cap 274 from within rotating shaft 180. An appropriate rod guide bushing may then be inserted within the end of rotating shaft 180 and the tube section inserted therein to an appropriate position for clamping by collet chuck assembly 190.

Figure 6:
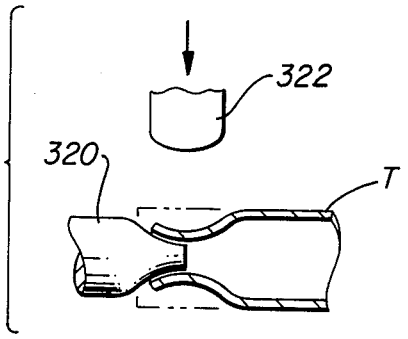
FIG. 6 illustrates an alternative embodiment of the present invention wherein the end of a tube section is formed using a mandrel therein.

The present invention may also be used to form the end of a tube section other than completely closing the end of the tube section. Referring to FIG. 6, the present invention may also be adapted to form the end of the tube section to the contour of a mandrel. In this arrangement, a mandrel 320 of a desired contour may be inserted within the end of tube section T and a forming wheel having a corresponding or complimentary contour 322 brought into engagement with the tube section and mandrel therein. The advancement of the forming wheel may be controlled by the adjustment of the position of microswitches 82 and 84 relative to their guide posts 90 and 92. Wheel 322 is free to rotate as it contacts and forms rotating tube section T. No heat is applied to tube section T. Because the present invention eliminates excessive friction engagement, no heat is generated during forming.

While the primary embodiment of the present invention wherein the apparatus is used to completely close the end of a tube has incorporated a forming wheel having a curvilinear groove 55 formed along the circumferential edge of one face of the wheel, it will be understood that the present invention also envisions the use of a right cylindrical forming wheel wherein no curvilinear groove is formed in the edge thereof. Likewise, the present invention also envisions the incorporation of other curvilinear grooves formed in the edge of the forming wheel other than that disclosed and described with respect to the primary embodiment.

Therefore, the present invention provides an apparatus for closing the end of a tube section wherein no application of heat is either externally applied or generated as a result of the forming operation. Thus, little if any distortion is introduced into the tube section either at the point of clamping of the tube section or forming of the end thereof. Additionally, the tube section may be easily handled at all times by the operator even upon completion of the closing of the end of the tube section. Further, the present invention provides an improved manner of positioning the tube section before the tube closing operation and for ejecting the completed piece. The present apparatus may be adapted for use with any length of tube section and may likewise be used to form the end of the tube section either using a mandrel or by controlling the movement of the forming wheel relative to the end of the tube section. This is accomplished with a minimum of components, requiring the rotation of only the tube section and permitting free rotation of the forming wheel.

Although preferred embodiments of the invention have been described in the foregoing detailed description and illustrated in the accompanying drawings, it will be understood that the invention is not limited to the embodiments disclosed, but is capable of numerous rearrangements, modifications and substitutions of parts and elements without departing from the spirit of the invention. The present invention is therefore intended to encompass such rearrangements, modifications and substitutions of parts and elements as fall within the scope of the appended claims.

I claim:

1. Apparatus for substantially closing the end of a tube section comprising:

rotary means for rotating said tube section about the longitudinal axis of the tube section, a forming wheel mounted relative to the end of said tube section, said forming wheel being freely rotatable about an axis substantially parallel to the rotational axis of the tube section, and means for moving said forming wheel in a plane substantially perpendicular to the axis of rotation of the tube section into engagement with the end of the tube section and beyond the axis of rotation of the tube section to substantially close the end thereof.

2. The apparatus according claim 1 wherein said forming of the end of the tube section is conducted without the application of heat to the tube section.

3. The apparatus according to claim 1 wherein said moving means moves said forming wheel across the full diameter of the tube section to close the end of the tube section.

4. The apparatus according to claim 1 wherein said forming wheel is a right cylinder section with a curvilinear surface formed along the circumferential edge of one face of said wheel, said curvilinear surface being positioned to contact the end edge of the tube section upon advancement of said forming wheel against the tube section.

5. The apparataus according to claim 4 wherein said curvilinear surface is concave.

6. The apparatus according to claim 4 wherein said curvilinear surface is a portion of a circle.

7. The apparatus according to claim 1 wherein said moving means comprises:

guide post means, a slide block slidable on said guide post means and rotatably supporting said forming wheel, and actuation means for moving said slide block relative to the tube section.

8. The apparatus according to claim 1 further comprising:

means for controlling the limit of movement of said forming wheel relative to the end of said tube section.

9. The apparatus according to claim 1 further comprising:

tube section adjustment means comprising clamp means for selectively clamping the tube section in said rotary means, adjustable stop means for positioning said tube section relative to said forming wheel, ejection means for ejecting the tube section from the clamp means upon release of said clamp means.

10. The apparatus according to claim 9 wherein said rotary means comprises a rotating tube supported for rotation about its longitudinal axis and clamp means mounted to one end of said rotating tube for receiving the tube section therein, and wherein said adjustable stop means comprises a stop rod mounted within said rotating tube, said rod being adjustable longitudinally within said rotating tube and having an end confronting the tube section mounted within said clamp means.

11. The apparatus according to claim 10 wherein said ejection means is mounted on the end of said stop means and comprises a cap member mounted on the end of said stop rod and a spring mounted between said cap member and the end of said stop rod.

12. An apparatus for closing the end of a pipe section comprising:

rotary means for rotating the pipe section about the longitudinal axis of the pipe section, a forming wheel mounted adjacent said rotary means and freely rotatable about an axis substantially parallel to the axis of rotation of the pipe secion, said forming wheel having a planar face confronting the end of the pipe section and substantially perpendicular to the axis of rotation of the pipe section, and means for moving said forming wheel in a plane substantially parallel to the planar face of said forming wheel into engagement with and across the end of the pipe section such that the outer edge of said forming wheel moves beyond the axis of rotation of the pipe section to close the end thereof without the application of heat.

13. The apparatus according to claim 12 wherein said forming of the end of the pipe section is conducted without the application of heat to the pipe section.

14. The apparatus according to claim 12 wherein said moving means moves said forming wheel across the full face of the pipe section to close the end of the pipe section.

15. The apparatus according to claim 12 wherein said forming wheel is a right cylinder section with a curvilinear surface formed along the circumferential edge of one face of said wheel, said curvilinear surface being positioned to contact the end of the pipe section upon advancement of said forming wheel against the pipe section.

16. The apparatus according to claim 12 wherein said curvilinear surface is concave.

17. The apparatus according to claim 12 wherein said moving means includes:

guide post means, a slide block slidable on said guide post means and rotatably supporting said forming wheel, and actuation means for moving said slide block relative to the pipe section.

18. The apparatus according to claim 12 further comprising:

means for controlling the limit of movement of said forming wheel relative to the end of said pipe section.

19. The apparatus according to claim 12 further comprising:

pipe section adjustment means comprising clamp means for selectively clamping the pipe section in said rotation means, adjustable stop means for positioning said tube section relative to said forming wheel, ejection means for ejecting the pipe section from the clamp means upon release of said clamp means.

20. The apparatus according to claim 19 wherein said rotary means comprises a rotating tube supported for rotation about its longitudinal axis and clamp means mounted to one end of said rotary means for receiving the pipe section therein, and wherein said adjustable stop means comprises a stop rod mounted within said tube, said rod being adjustable longitudinally within said tube and having an end for confronting the pipe section mounted within said clamp means.

21. The apparatus according to claim 19 further comprising:

ejection means mounted on the end of said stop means comprising a cap member and a spring mounted between said cap member and the end of said stop rod.

22. A method for closing the end of a pipe section comprising:

rotating the pipe section about the longitudinal axis thereof, supporting a freely rotatable forming wheel adjacent the end of the pipe section, the wheel having a planar face confronting the pipe section end and substantially perpendicular to the axis of rotation of the pipe section, and moving the forming wheel in a plane substantially parallel to the planar face of the wheel and across the end of the pipe section such that the edge of the forming wheel moves beyond the axis of rotation of the pipe section to close the end of the pipe section.

23. An apparatus for substantially closing the end of a tube section comprising:

rotary means for rotating said tube section about the longitudinal axis of the tube section, a forming wheel rotatable mounted relative to the end of said tube section with an unsupported forming face substantially perpendicular to the axis of the tube, said forming wheel being freely rotatable about an axis substantially parallel to the longitudinal axis of the tube section, and means for moving said forming wheel into engagement with and across the end of the tube section and beyond the axis of rotation of the tube section to substantially close the end thereof.

24. The apparatus according to claim 23 wherein said moving means moves said forming wheel across the diameter of the tube section such that the axis of rotation of the forming wheel passes to the axis of rotation of the tube section.

* * * * *